United States Patent [19]

Jeschke et al.

[11] 4,089,264

[45] May 16, 1978

[54] INKING UNIT FOR PRINTING MACHINES

[75] Inventors: Willi Jeschke, Heidelberg; Wolfgang Pfizenmaier, Seeheim, Bergstr., both of Germany

[73] Assignee: Heidelberger Druckmaschinen Aktiengesellschaft, Heidelberg, Germany

[21] Appl. No.: 702,141

[22] Filed: Jul. 2, 1976

[30] Foreign Application Priority Data

Jul. 5, 1975 Germany ..... 2530109

[51] Int. Cl.[2] ..... B41F 31/04

[52] U.S. Cl. ..... 101/365; 101/169

[58] Field of Search ..... 101/365, 350, 157, 169, 101/363

[56] References Cited

U.S. PATENT DOCUMENTS

| | | | |
|---|---|---|---|
| 3,730,087 | 5/1973 | Trant et al. | 101/169 |
| 3,898,931 | 8/1975 | Posselt | 101/365 |
| 3,902,420 | 9/1975 | Greiner et al. | 101/365 |
| 3,964,386 | 6/1976 | Dini | 101/169 |

*Primary Examiner*—J. Reed Fisher

*Attorney, Agent, or Firm*—Herbert L. Lerner

[57] ABSTRACT

Inking unit for a printing machine includes an ink duct, a ductor roller having a surface engageable with ink received in the ink duct, an ink transfer roller for transferring ink from the ductor roller to other rollers, a ductor knife engageable along the length thereof with the surface of the ductor roller and adjustable in position relative to the surface of the ductor roller in zones extending along the length of the ductor knife for controlling the amount of ink to be transferred, and means for adjusting the zones of the ductor knife pulse-like into engagement with and disengagement from the surface of the ductor roller with strokes of equal length and with a stepwise variable stroke time.

4 Claims, 3 Drawing Figures

INKING UNIT FOR PRINTING MACHINES

The invention relates to an inking unit for printing machines that includes an ink duct, a duct roller, an ink transfer roller, and inking unit rollers, and wherein the amount of ink to be transferred to the inking unit rollers or mechanism is adjustable zonewise by means of a ductor knife.

When used in high capacity or heavy duty printing machines, inking units of this type are equipped with a remote control system for the individual zone screws, by means of which the quantity of ink of each zone to be transferred can be regulated from a control desk. In addition, the individual zone screws permit presetting or preadjustment of the ductor knife in accordance with the quantity of ink required for the respective image that is to be printed.

The inking unit heretofore known from German Pat. No. 1,241,840 utilizes an analogous means for adjusting the zone screw on the ductor knife with the aid of pawls. The latter are actuated by an entraining pin for as long as the appertaining push-button switch is depressed. The period of time during which the switch is depressed thus determines the adjustment travel or displacement of the zone screws. In order to be able to ascertain the extent of adjustment travel or displacement and the errors occurring in the course of the adjustment travel or displacement, a rotary potentiometer is associated with each zone screw and indicates by means of an ammeter the respective degree or extent of adjustment of the ductor knife. In addition to the heavy cost of construction of the adjusting mechanism per se, this heretofore known construction thus requires an additional check-back signal and indication of the adjusted value.

If the operator or servicing personnel wishes to adjust the quantity of ink supplied to a zone by a given amount, he or she must actuate the push-button switch until the indication has been increased or diminished by the respective amount. This requires a high degree of vigilance, particularly because the periods of adjustment and the adjustment values may vary due to occurring faults or defects in the adjusting mechanism. In practice, this not only gives rise to the danger of misadjustment but, in addition, the printer is forced to regulate or readjust until he has attained the desired degree of adjustment.

This burden on the operator and the danger of misadjustment or misregulation also exist in the case of zonewise ink presetting. The heretofore known device of the aforementioned German Patent thus demands a considerable expense for construction, a high degree of vigilance during adjustment, and a correspondingly great expenditure of time especially for the presenting or preadjustment of the inking unit in accordance with the printed image that is to be produced.

Other heretofore known adjusting devices for ductor knife differ only with respect to the means used for turning the ink zone screws and the control elements required for that purpose.

It is accordingly an object of the invention to provide an inking unit for a printing machine which effects zonewise adjustment of the quantity of ink to be transferred to the inking unit, wherein the quantity of ink is accurately adjustable without falsification of this adjustment due to faults or detects in transfer or transmission.

In accordance with another object of the invention, the inking unit affords the elimination of check-back signals and a reduction in construction expenditures and servicing or operating time.

With the foregoing and other objects in view, there is provided in accordance with the invention, an inking unit for a printing machine comprising an ink duct, a ductor roller having a surface engageable with ink received in the ink duct, an ink transfer roller for transferring ink from the ductor roller to other rollers, a ductor knife engageable along the length thereof with the surface of the ductor roller and adjustable in position relative to the surface of the ductor roller in zones extending along the length of the ductor knife for controlling the amount of ink to be transferred, and means for adjusting the zones of the ductor knife pulse-like into engagement with and disengagement from the surface of the ductor roller with strokes of equal length and with a stepwise variable stroke time.

In accordance with another feature of the invention, the adjusting means include means for applying the strokes with uniform frequency.

With this digital adjustment of the ductor knife, the period of time during which the ductor knife zone is moved away from the ductor roller a given distance is varied, so that, in this period, a corresponding quantity of ink can be transferred into the inking mechanism. Due to preselection of the number of pulses in the stroke time period, adjustment without any check-back signal is assured.

In accordance with an alternate feature of the invention, and wherein the inking unit is in combination with a printing machine, the adjusting means include means for applying the strokes with a controlled frequency depending upon the operating speed of the printing machine. By controlling the frequency in dependence upon the speed of operation of the machine, an additional advantage is attained in that the stroke frequency can be reduced, especially for low machine speeds.

In accordance with a further feature of the invention, the adjusting means comprise electromagnetic devices mounted on the ink duct and having armatures, respectively, associated with the zones of the ductor knife, resilient straps respectively secured to the ductor knife at the zones thereof, and means operatively connecting the armatures to the resilient straps, respectively, for flexing the respective straps in a loopwise manner upon energization of the respective electromagnetic device and displacement of the respective armatures.

In accordance with an additional feature of the invention, the means operatively connecting to the resilient straps, respectively, comprise respective levers secured at one end thereof to the respective straps and engageable at the other end thereof by the respective armatures.

In accordance with yet another feature of the invention, the adjusting means comprise a control connected to the electromagnets and including a pulse generator having an output, a shift register having an input connected to the output of the pulse generator and having outputs, in turn, and coding switches having respective inputs connected to the outputs of the shift register, and having respective outputs, in turn, connected to the respective electromagnetic devices.

In accordance with a concomitant feature of the invention, and wherein the inking unit is in combination with a printing machine having a main rotary shaft, the pulse generator comprises a rotary member having a rotary speed determined by the rotary speed of the printing machine shaft.

The invention thus renders possible the transfer of a quantity of ink accurately determined for each ductor knife zone and to be preadjusted or preset by means of a coding switch. In addition, no faults or defects in transfer can occur which could unintentionally and undesirably affect the inking.

Instead of the electrical control means disclosed as forming part of the invention, hydraulically or pneumatically actuable control means can be used with equal success.

Other features which are considered as characteristic for the invention are set forth in the appended claims.

Although the invention is illustrated and described herein as embodied in inking unit for printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
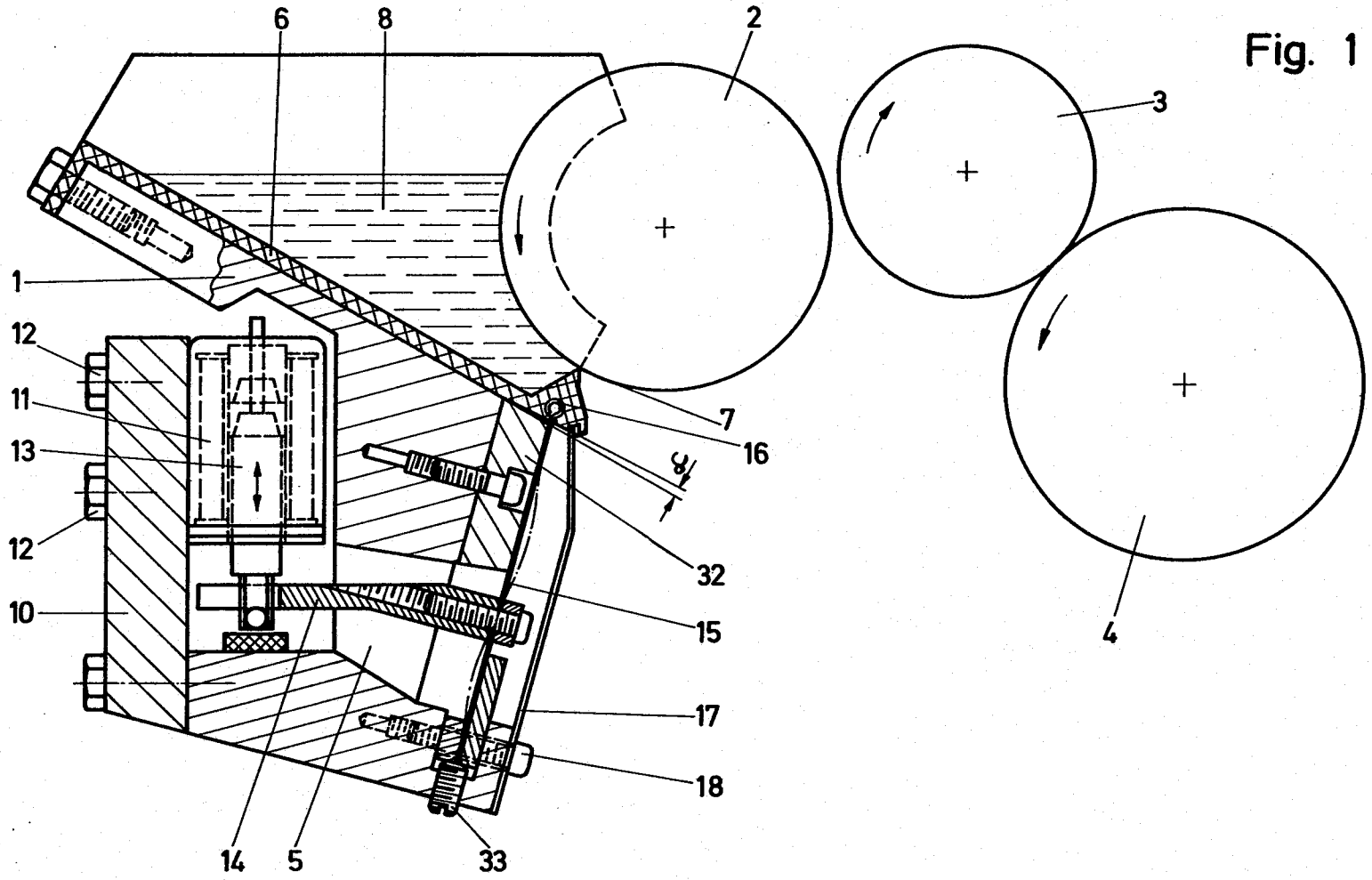
FIG. 1 is a diagrammatic side elevational view, partly in section, of the inking unit of the invention.

The inking unit shown in the embodiment of FIG. 1 is formed of an ink receptacle or duct 1, a ductor roller 2, an ink transfer roller 3, and inking mechanism rollers, of which only the first roller 4 is shown. The ink transfer roller 3 may be a conventional film roller or lifter roller.

Figure 2:
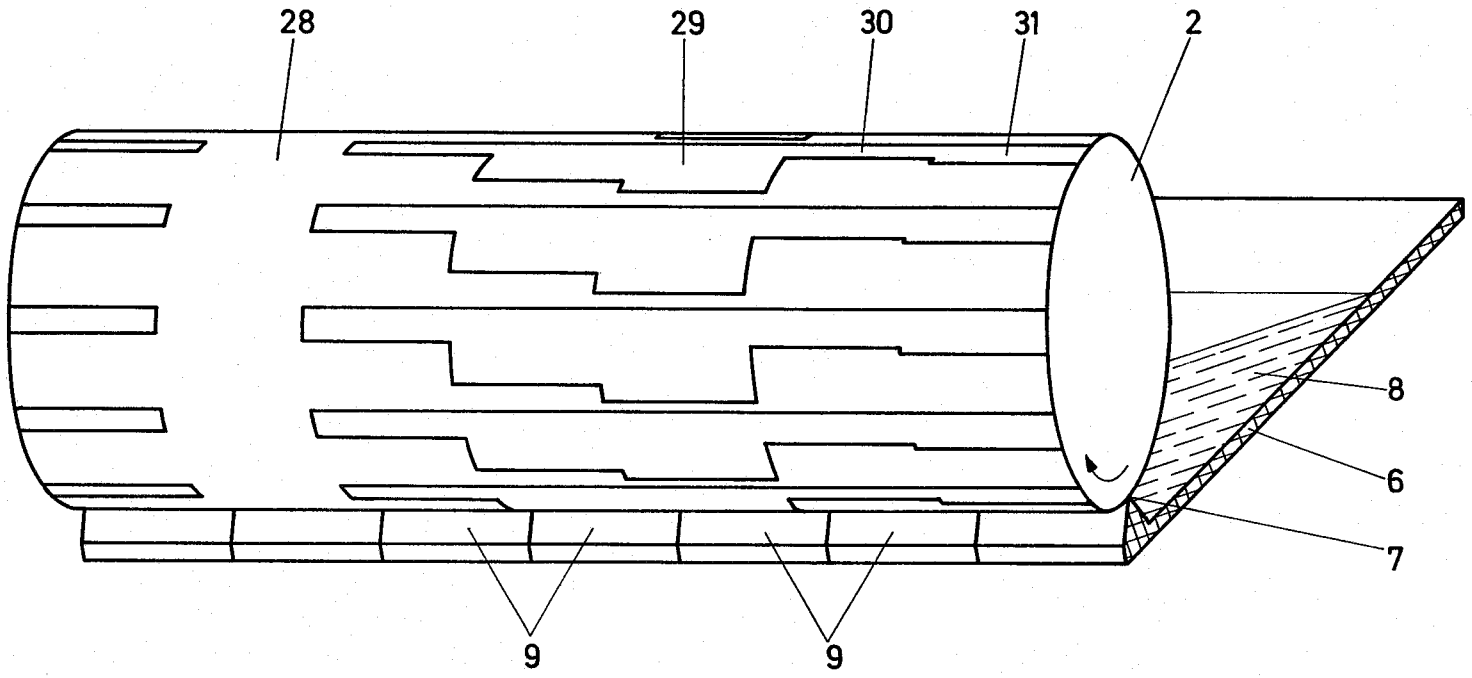
FIG. 2 is a perspective view of the ductor roller of the inking unit showing the ink relief thereon.

The ink duct 1 is mounted in non-illustrated side frames extending parallel to the plane of the drawing of FIG. 1 and can be swung away from the ductor roller 2. In the upper portion of the ink duct 1, as viewed in FIG. 1, an ink blade or ductor knife 6 is carried. The ductor knife 6 has a stripper edge 7 which bears against the ductor roller 2. The ink 8 is located above the ductor knife 6, as viewed in FIG. 1. In the region of the stripping edge 7 thereof, the ductor knife 6 is divided along the length thereof into zones 9 (FIG. 2). When a ductor knife 6 formed of elastic material is used, however, separation or parting lines between the individual zones 9 are not required.

Respective electromagnets 11 are associated with the individual zones 9 of the ductor knife 6, and are threadedly secured by means of bolts 12 to a bar 10 fastened on the ink duct 1. When the electromagnets 11 are energized, magnet armatures 13 thereof are attracted and act on levers 14 disposed in apertures 5 formed in the ink duct 1. Spring bands or resilient straps 15 screwed to the respective levers 14 are thereby bent or flexed into a loop-shaped form (diagrammatically shown in phantom) and thus the effective length is shortened in relation to that of the extended condition thereof shown in solid lines.

The spring bands 15, which are provided respectively for each ductor knife zone 9, are fastened at one end thereof by eyes 16 to the zones 9 (FIG. 2) of the ductor knife 6, and at the opposite end thereof threadedly secured or screwed to the ink duct 1. Due to the flexing of the spring bands 15 and the consequent effective shortening thereof, the zones 9 in the region of the stripping edges 7 thereof are bent away from the ductor roller 2 to the extent of the angle $\alpha$. An accurately determined gap of 0.3 mm, for example, which remains the same, respectively, is thereby formed between the stripping edges 7 and the ductor roller 2. Depending upon the gap and thus upon the stroke performed by the stripping edge 7, an ink stripe remains on the ductor roller 2 and is transmitted by the following transfer roller or rollers 3 to the inking mechanism represented by the illustrated inking mechanism roller 4. During this action, the zones 9 come to bear against a stop bar 32. The stripping edges 7 are adjustable relative to the ductor roller 2 by a single one-time adjustment of adjusting screws 33, with the spring bands 15 extended.

In order to prevent soiling of the control mechanism, a sleeve 17, which is fastened to the ink duct 1 by means of screws 18, is disposed in a forward region of the ductor knife 6, as viewed from the right-hand side of FIG. 1.

Figure 3:
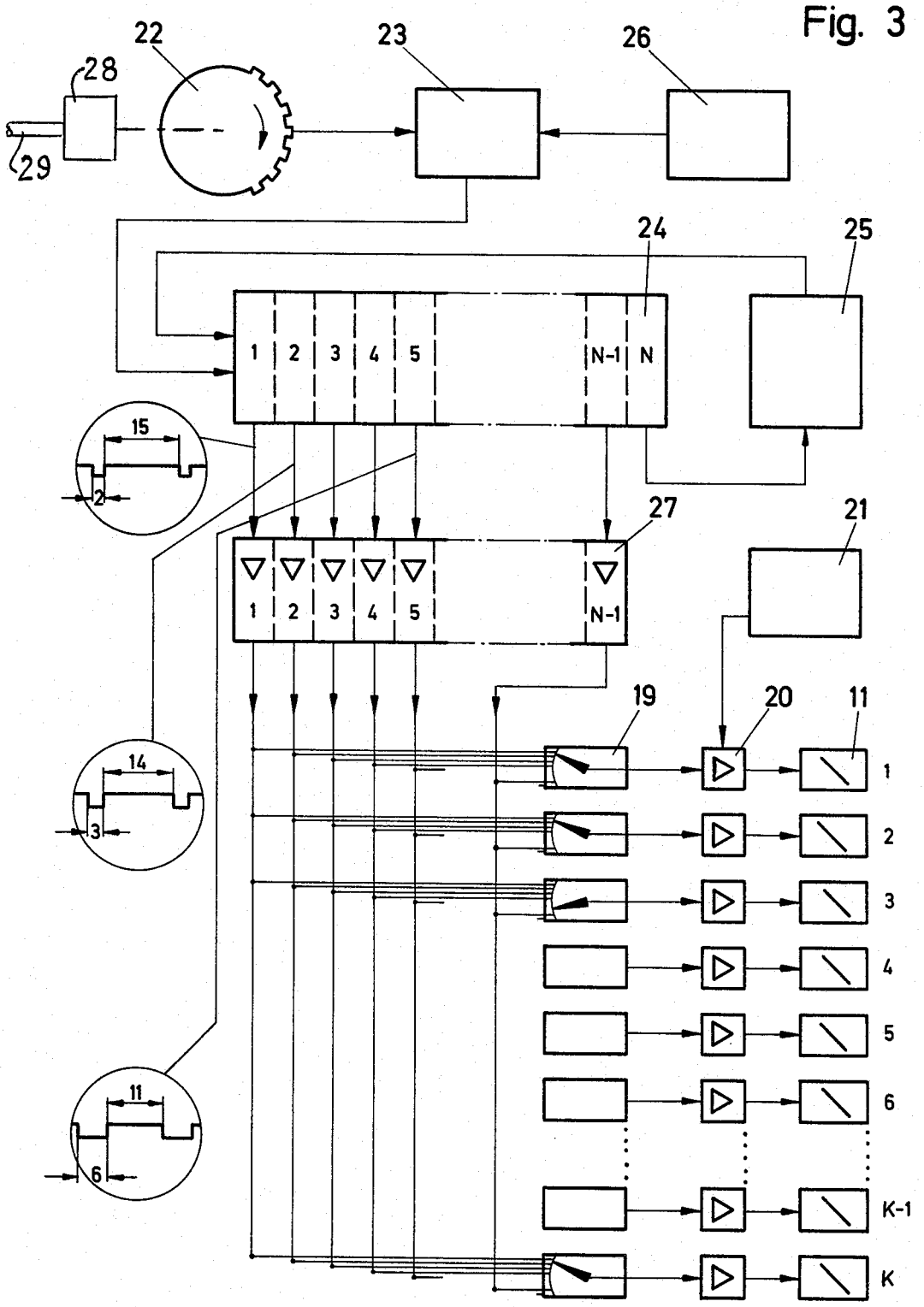
FIG. 3 is a schematic diagram of the control means for the inking unit.

FIG. 3 schematically illustrates the control system for the electromagnet 11 in a case wherein the ductor knife 6 is divided into 32 zones 9. Control of the electromagnets 11, each of which is associated respectively with one of the 32 ductor-knife zones 9, is effected by 32 coding switches 19, which act upon the magnets 11 through the intermediary of a corresponding number of conventional terminal or output stages 20. The terminal stages 20 are supplied with a voltage of 60 volts by a conventional voltage supply unit 21. One of the heretofore described means is required for each inking unit.

Irrespective of the number of inking units, each printing machine is equipped with one conventional pulse generator 22 which acts through a conventional pulse pick-up or receiver 23 on a conventional shift register 24 provided with a conventional reset device 25. These devices operate with a 12-volt voltage supply 26. The shift register 24 has a second input which is internally wired.

A number of power amplifiers 27 are connected to the output of the shift register 24 in accordance with the number of control pulses selected, the specific number of power amplifiers 27 in the illustrated embodiment being fifteen. The 15 stages of the shift register 24 are connected by 15 lines to the 15 power amplifiers 27. The 15 power amplifiers 27 transmit the various signals to the 32 coding switches 19 of each inking unit. Each of the coding switches 19 being connected to all 15 lines for every selected control pulse count.

The mode of operation of the individual control devices is as follows: The pulse generator 22 is driven at a predetermined rotary speed and, in accordance with this speed, produces a given frequency i.e. a predetermined number of pulses per second, which is transmitted by the pulse pick-up 23 to a 16-stage shift register 24. In the chosen embodiment of the invention, the shift register 24 is connected so that 15 switching pulses are counted with the first 15 stages, and two pause pulses with the 16th stage. The pulses serve for resetting in the shift register 24. The 15 stages of the shift register 24 thus afford a bandwidth of the opening time periods of the ductor knife zones ranging between 15 to 2 and 1 to 16 or, in other words, from being open for 15 pulses and closed for two pulses to being open for one pulse and closed for 16 pulses.

Each switching pulse is then fed over a separate line to a power amplifier 27. The number of pulses transmitted from line to line is accordingly increased or diminished by one pulse, such as, for example, 15 switch pulses and two pause pulses transmitted over a first line and 14 switch pulses and three pause pulses over the next line. This continues stepwise up to the 15th line over which one switch pulse and 16 pause pulses are then transmitted. During the pause pulses, the respective ductor knife zone 9 engages the ductor roller 2.

The ratio between the switching or work pulses and the pause pulses is preselected at a scale between 0 and 15 at the respective coding switches 19 and the adjustment or setting provided thereat is transmitted to the electromagnets 11. By means of this manual selection of the switching or working pulses at each of the 32 coding switches 19, any desired ductor knife zone adjustment can be effected, the adjustment or setting of each zone 9 can be read at the location of the selector switch with respect to the scale. The electromagnets 11, in turn, lift the stripping edge 7 away from the ductor roller 2 in accordance with the selected number of pulses or pulse count, the stroke time being thereby determined. In accordance with the respective ductor speed, a zone-wide ink stripe of varying length is produced during the stroke period and then transferred into the inking unit. The zero setting is not connected to any line so that, in that setting, the ductor knife zone 9 is always in engagement with the ductor roller 2 and, accordingly, in that range, no ink is transferred into the inking unit.

With the digital control, pulse-like engagement and disengagement of the ductor knife zones 9 is achieved, for the same stroke of the zones 9 and for the same frequency, but with a stepwise variable stroke time through the coding switches 19.

The pulse generator 22 can be driven in dependence upon the speed of the printing machine, so that the frequency is increased in accordance with increasing machine speed. Nothing changes thereby in the succeeding control means. Through the rotary speed-dependent control of the frequency, the stroke time of the zones 9 can be reduced, especially at low machine speeds. It is advantageous to employ such a modified form of the invention for a lifting inking unit and to set the number of strokes of the zones 9 into a specific integral ratio with respect to the engagement period of the lifter roller.

The ink relief formed of the ductor roller 2, as shown in FIG. 2, permits zonewise accommodation or adjustment of the amount of ink to be transferred to the inking unit or mechanism. In the region 28, the appertaining zone 9 of the ductor knife 6 is not lifted away from the ductor roller 2, so that also no ink is transferred. In the region 29, the maximal amount of ink is transferred by the ductor roller 2, which means that at the given frequency, the appertaining zone 9 of the ductor knife 6 is lifted away from the ductor roller 2 for 15 pulses and held in contact therewith for two pause pulses. The regions 30 and 31 reflect a difference of one pulse i.e. from six working or switching pulses to seven working or switching pulses, for example. With the ink relief illustrated in FIG. 2, it is clearly shown that any zonewise ductor knife adjustment can be attained corresponding to the printed image that is to be produced.

As shown, diagrammatically in FIG. 3, the pulse generator 22 may include a rotary cam disc, or the like, which is rotated at a uniform rotary speed or which is rotated through a suitable gear transmission and clutch assembly 28, for example, connectible to the main shaft 29 of a printing machine of course, other pulse generators, such as suitable electrical circuits, as well as other means for activating the pulse generator in accordance with the rotary speed of any suitable rotating part of the printing machine may be employed in the control system of the invention.

There are claimed:

1. Inking unit for a printing machine comprising an ink duct, a ductor roller having a surface engageable with ink received in said ink duct, an ink transfer roller for transferring ink from said ductor roller to other rollers, a ductor knife engageable along the length thereof with the surface of said ductor roller and adjustable in position relative to the surface of said ductor roller in zones extending along said length of said ductor knife for controlling the amount of ink to be transferred, and means for adjusting said zones of said ductor knife pulse-like into engagement with and disengagement from the surface of said ductor roller with strokes of equal length and with a stepwise variable stroke time, said adjusting means comprising electromagnetic devices mounted on said ink duct and having armatures, respectively, associated with the zones of said ductor knife, resilient straps respectively secured to said ductor knife at said zones thereof, and means operatively connecting said armatures to said resilient straps, respectively, for flexing the respective straps in a loopwise manner upon energization of the respective electromagnetic device and displacement of the respective armatures.

2. Inking unit according to claim 1 wherein said means operatively connecting said armatures to said resilient straps, respectively, comprise respective levers secured at one end thereof to the respective straps and engageable at the other end thereof by the respective armatures.

3. Inking unit according to claim 1 wherein said adjusting means comprises a control device connected to said electromagnets and including a pulse generator having an output, a shift register having an input connected to the output of said pulse generator and having outputs, in turn, and coding switches having respective inputs connected to the outputs of said shift register, and having respective outputs, in turn, connected to the respective electromagnetic devices.

4. Inking unit according to claim 3 in combination with a printing machine and having a main rotary shaft, wherein said pulse generator comprises a rotary member having a rotary speed determined by the rotary speed of the printing machine shaft.

* * * * *